US007198087B2

(12) United States Patent
Hsu

(10) Patent No.: US 7,198,087 B2
(45) Date of Patent: Apr. 3, 2007

(54) ROMAN TYPE BLIND DRAPERY STRUCTURE

(75) Inventor: Ben Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 10/885,597

(22) Filed: Jul. 8, 2004

(65) Prior Publication Data

US 2005/0252617 A1 Nov. 17, 2005

(30) Foreign Application Priority Data

May 14, 2004 (TW) ..... 93207535 U

(51) Int. Cl.
*A47H 5/00* (2006.01)

(52) U.S. Cl. ..... 160/84.01; 160/168.1 R

(58) Field of Classification Search ..... 160/84.01, 160/84.04, 84.05, 84.06, 168.1 R, 170, 172 R
See application file for complete search history.

(56) References Cited

U.S. PATENT DOCUMENTS 1,482,978 A * 2/1924 Edwards ..... 160/84.01
1,498,594 A * 6/1924 Watson ..... 211/103
3,913,655 A * 10/1975 Ogino ..... 160/84.01
2005/0039862 A1* 2/2005 Lin ..... 160/84.01

* cited by examiner

*Primary Examiner*—Blair M. Johnson
(74) *Attorney, Agent, or Firm*—Troxell Law Office, PLLC

(57) ABSTRACT

A Roman-type blind drapery structure includes a Roman-type drapery made up of a blind body wherein the blind body has an upper tubular section transversely disposed at the top edge thereon for an upper beam made of a major/minor telescopic rod to be led there-through, and both ends of the pull cord are led vertically downwards from the bottom edge of the upper tubular section to pass sequentially through a plurality of cord-passage hoops that are equidistantly seamed from top to bottom in axial position relative to the pull cord at the rear side of the blind body thereon. A lower tubular section is disposed at the lower section of the blind body for a rod-like counterweight to be located therein, and both ends of the pull cord are correspondingly drawn inwards and gathered up by a retaining piece to form a pulling section suspending downwards at the ends thereof. Thus, the upper beam thereof is simply led through the upper tubular section of the blind body to complete the assembly of the Roman-type drapery thereof, and the blind body mounted onto the upper beam thereof is easily detached there-from for the replacement of another blind body of different design without the upper beam being changed therewith, facilitating the various decorative effect as well as easy assembly and replacement of the Roman-type drapery thereof to boost the economical efficiency and competitive power thereof.

6 Claims, 5 Drawing Sheets

ROMAN TYPE BLIND DRAPERY STRUCTURE

BACKGROUND OF THE INVENTION

The present invention is related to a roman type blind drapery structure, including a Roman-type drapery made up of a blind body with an upper tubular section transversely disposed at the top edge thereon for an upper beam made of a major/minor telescopic rod to be led there-through, a plurality of cord-passage hoops equidistantly seamed from top to bottom at the rear side of the blind body thereon for both ends of a pull cord to be led sequentially there-through, and a lower tubular section laterally extending at the lower section of the blind body for a rod-like counterweight to be located therein, permitting the blind body to suspend naturally and smoothly downwards when stretched fully or partially open in practical use; whereby, the upper beam thereof, adjustable to window frame of various sizes, is simply led through the upper tubular section of the blind body to complete the assembly of the Roman-type drapery thereof, and the blind body mounted onto the upper beam thereof is easily detached there-from for the replacement of another blind body of different design without the upper beam being changed therewith, facilitating the various decorative effect as well as easy assembly and replacement of the Roman-type drapery thereof to boost the economical efficiency and competitive power thereof.

Please refer to FIG. 1. A conventional Roman type blind drapery includes a Roman-type drapery 10 made up of an upper beam 11, and a blind body 12 of proper length and width fixedly attached to the underside of the upper beam 11 thereof wherein the blind body 12 is sequentially folded backwards in equal space and seamed up into double layers to form a plurality of elongated through holes 13 from top to bottom thereon, and a plurality of retaining hoops 14 are symmetrically riveted at both left and right sides of the elongated through holes 13 in equal distance thereon for both ends of a pull cord 15 to be led sequentially there-through. A roller mount 16 is disposed at one inner side of the upper beam 11 therein to clamp tight the pull cord 15 for location thereby. Both ends of the pull cord 15 are securely fixed to the bottommost retaining hoops 14 thereof. Thus, when the elongated through holes 13 are actuated by the bottommost retaining hoops 14 raised upwards by the pull cord 15 thereof, the blind body 15 is sequentially gathered up and suspended downwards into multi-layers.

There are some drawbacks to such conventional Roman-type drapery 10. First, the blind body 12 is directly fixed to the underside of the upper beam 11, and both the blind body 12 and the upper beam 11 are unable to be adjusted according to the size of different window frames. In case the Roman-type drapery 10 purchased is unfit to the size of a window frame, the Roman-type drapery 10 must be either replaced with a new one or made do for an improper window frame, which is inconveniently limited in decoration as well as assembly thereof. Second, the blind body 12, fixedly attached to the underside of the upper beam 11, must be dismantled along with the upper beam 11 in one set for the replacement of another blind body 12 of different design, which is quite limited in variation and may increase the cost in purchase. Third, the roller mount 16 must be assembled to the inner side of the upper beam 11 to clamp tight the pull cord 15 for location thereby, which is quite complex in the assembly parts. Besides, the blind body 12 must be folded and seamed up in equal distance to provide the elongated through holes 13 for the retaining hoops 14 to be symmetrically riveted thereto before the pull cord 15 is sequentially led through the retaining hoops 14 and located by the roller mount 16 adapted at the upper beam 11 therein, which, complicated and time-consuming in assembly thereof, makes the conventional Roman-type drapery 10 uncompetitive in the market.

SUMMARY OF THE PRESENT INVENTION

It is, therefore, the primary purpose of the present invention to provide a roman type blind drapery structure, including a Roman-type drapery made up of a blind body with an upper tubular section transversely disposed at the top edge thereon for an upper beam made of a major/minor telescopic rod to be led there-through wherein the upper beam, individually set apart from the blind body thereof, can be adjusted in length to suit the size of different window frames, and the blind body mounted onto the upper beam thereof is easily detached there-from for the replacement of another blind body of different design without the upper beam being changed therewith, efficiently reducing the cost of the Roman-type drapery in replacement and facilitating the various decorative effect as well as easy assembly and replacement thereof.

It is, therefore, the second purpose of the present invention to provide a Roman-type blind drapery structure wherein both ends of a pull cord fixed to the bottom edge of the upper tubular section of the blind body thereof are led downwards to pass sequentially a plurality of cord-passage hoops that are equidistantly seamed from top to bottom at the rear side of the blind body thereon till gathered up by a retaining piece in clamping location thereby without a roller mount being adapted to the inner side of the upper beam of a conventional Roman-type drapery to achieve the economical efficiency and boost the competitive power thereof.

It is, therefore, the third purpose of the present invention to provide a Roman-type blind drapery structure wherein, via a retaining through ring disposed at the lower section of the blind body, the pull cord and the retaining piece thereof can be mounted at the front or the rear sides of the blind body thereof according to the habit of a user, making the Roman-type blind drapery structure more humane in operation thereof.

DETAILED DESCRIPTION OF THE PREFERRED EMBODIMENTS

Figure 1:
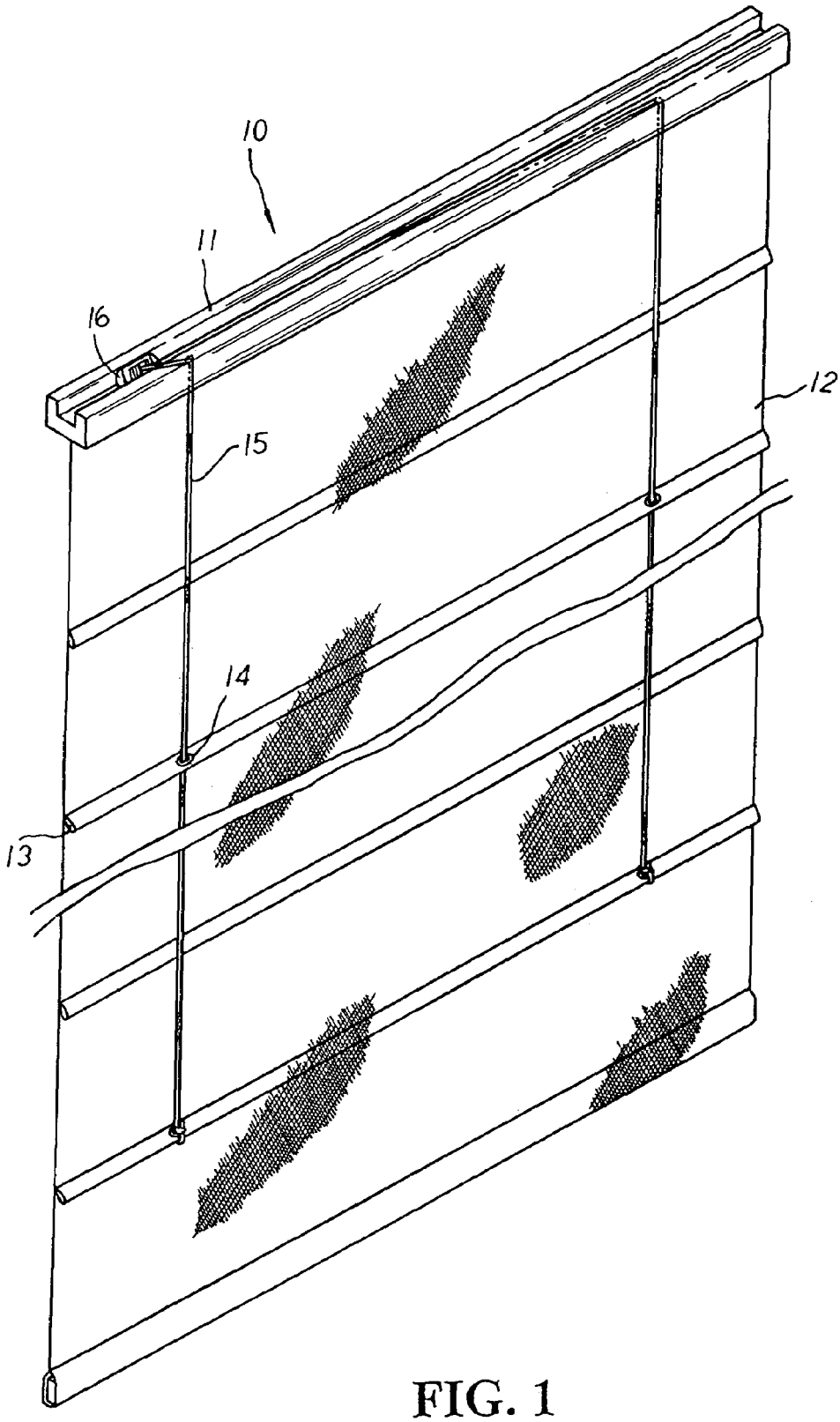
FIG. 1 PRIOR ART
FIG. 1 is a perspective view of a conventional Roman type blind drapery structure.
Figure 2:
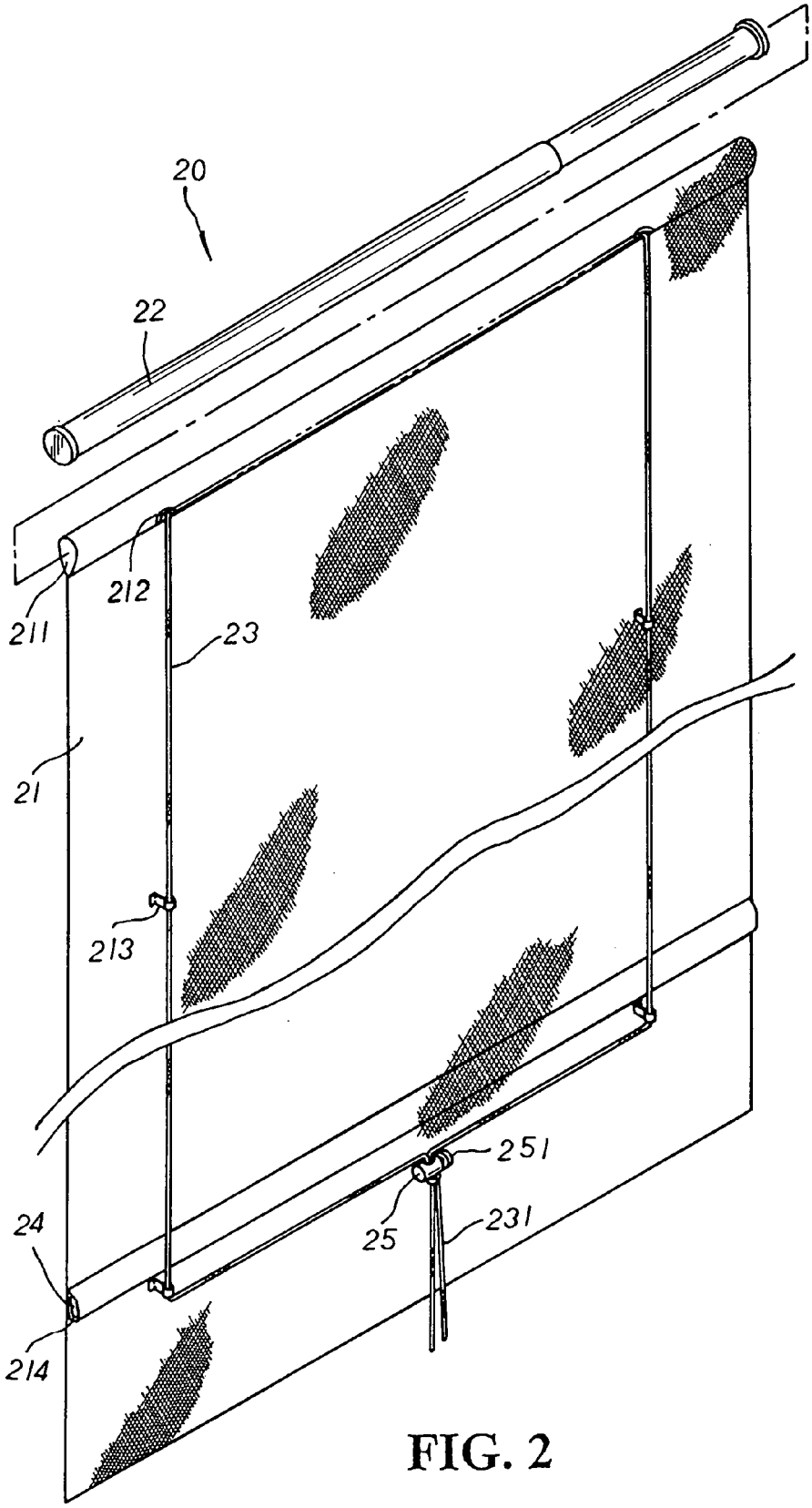
FIG. 2 is a perspective exploded view of the present invention.
Figure 3:
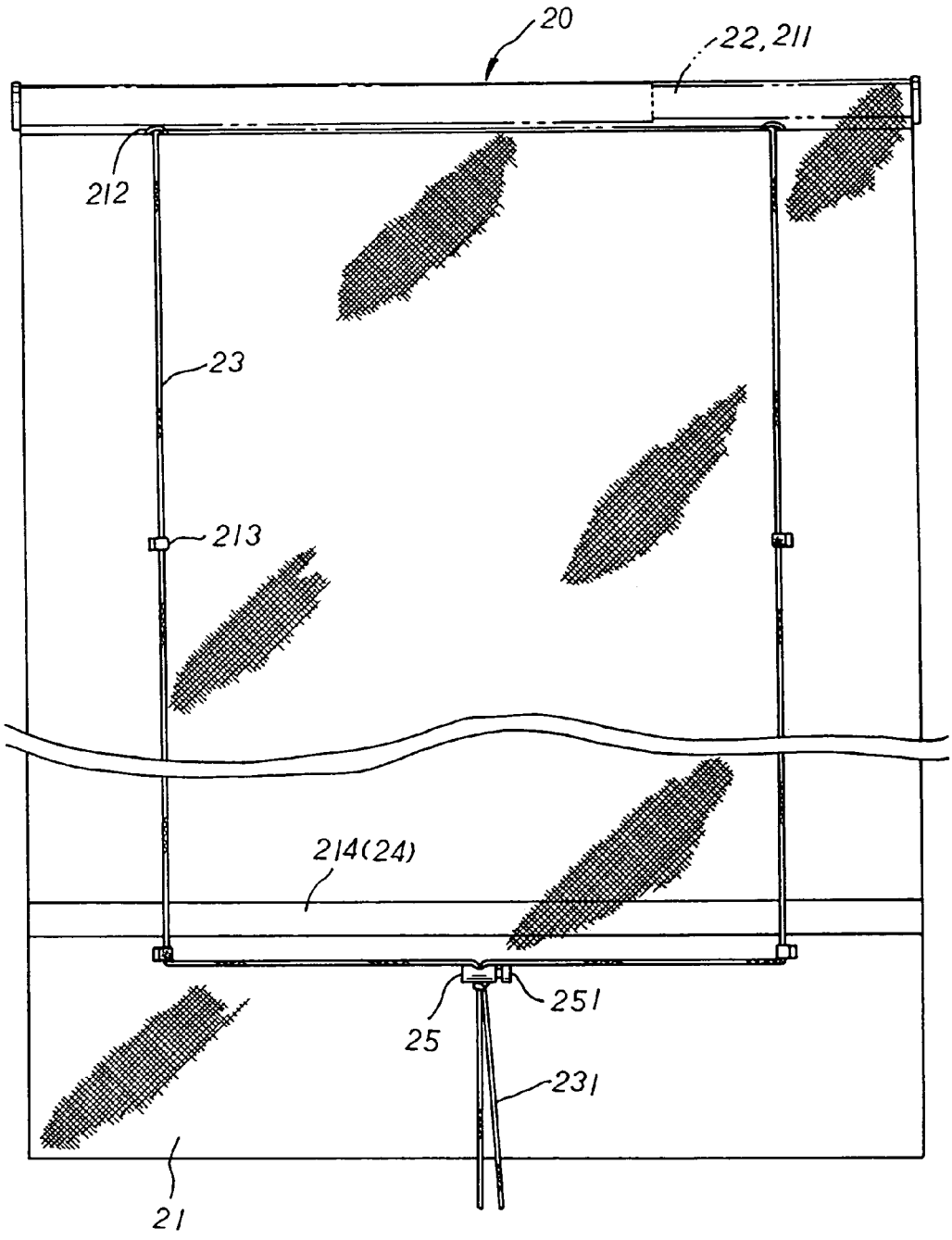
FIG. 3 is a plane view of the present invention in assembly.
Figure 4:
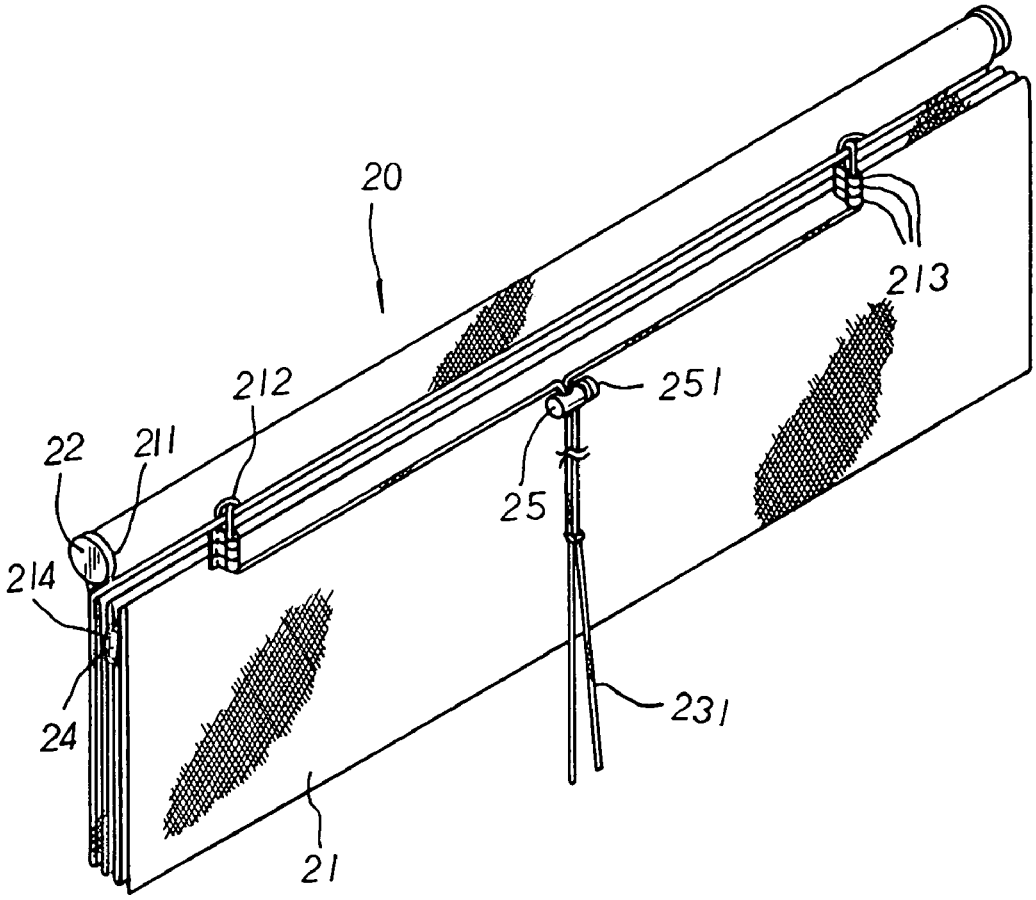
FIG. 4 is a diagram showing a gathered-up blind body of the present invention.

Please refer to FIGS. 2 to 4 inclusive. The present invention is related to a Roman-type blind drapery structure, including a Roman-type drapery 20 made up of a blind body 21 having an upper tubular section 211 transversely disposed at the top edge thereon for an upper beam 22 made of a major/minor telescopic rod to be led there-through. Cord-passage rings 212 are properly preset at the rear bottom edge of the upper tubular section 211 thereof for both ends of a pull cord 23 to be passed there-through respectively from the inner side of the upper tubular section 211, and a plurality of cord-passage hoops 213 are equidistantly seamed from top to bottom at the rear side of the blind body 21 thereon axially in alignment with the cord-passage rings 212 thereof for both ends of the pull cord 23 to be led downwards there-through in a sequence. A lower tubular section 214 is laterally disposed at the lower section of the blind body 21 for a rod-like counterweight 24 to be located therein, permitting the blind body 21 to suspend naturally and smoothly downwards when stretched fully or partially open in practical use. Both ends of the pull cord 23 are correspondingly drawn inwards and gathered up by a retaining piece 25 at the middle of the blind body 21 thereof before extending side by side downwards for a proper length to form a pulling section 231 at the ends thereof. The retaining piece 25 has a push button 251 protruding outwards at one side thereof to control the adjustment of the pull cord 23 via pressing operation thereby. And via the retaining piece 25 thereof, the pull cord 23 is properly unfolded or withdrawn and stably held in place thereby as shown in FIG. 4. In practical use, the upper beam 22, individually separable from the blind body 21 thereof, is capable of being adjusted in length to fit to window frames of various sizes. And the upper beam 22 thereof is simply led through the upper tubular section 211 of the blind body 21 to complete the assembly of the Roman-type drapery 20 thereof. For variation of the Roman-type drapery 20 thereof, the blind body 21 mounted onto the upper beam 22 thereof is easily detached there-from for the replacement of another blind body of different design without the upper beam 22 being changed therewith, efficiently reducing the cost of the Roman-type drapery 20 in assembly and replacement thereof as well as achieving various decoration effect to boost the competitive power thereof.

Figure 5:
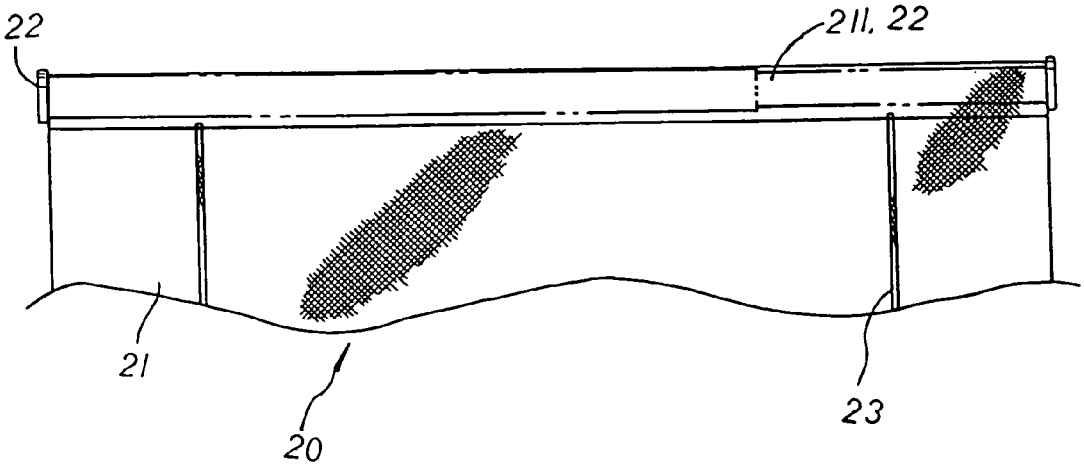
FIG. 5 is a partially plane view of another embodiment of the present invention in assembly.

Please refer to FIG. 5. Both upper ends of the pull cord 23 of the Roman-type drapery 20 thereof can also be fixedly attached to the rear bottom edge of the upper tubular section 211 thereof and axially aligned with the cord-passage hoops 213 of the blind body 21 thereof.

Figure 6:
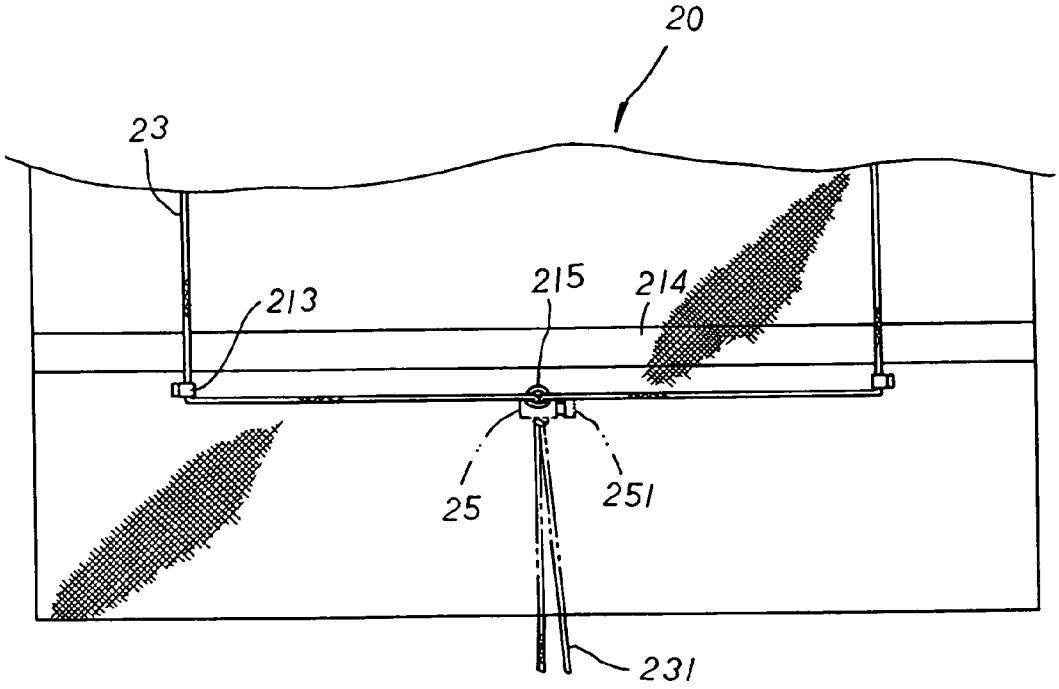
FIG. 6 is a partially plane view of a third embodiment of the present invention in assembly.

Please refer to FIG. 6. A retaining through ring 215 is disposed under the counterweight 21 at the middle section of the blind body 21 thereof. Both ends of the pull cord 23 extending vertically downwards to pass through the cord-passage hoops 215 sequentially at the rear side of the blind body 21 thereof are led through the retaining through ring 215 to come out at the other side thereof before gathered up by the retaining piece 25 and suspended downwards for a proper length to form the pull section thereof, permitting the pull cord 23 to be controlled via the retaining piece 25 at the front side of the blind body 21 according to the habit of consumers and facilitating an easier and more humane way of operation of the Roman-type drapery 20 thereof.

What is claimed is:

1. A Roman-type blind drapery structure comprising:

a) a blind body movable between raised and lowered positions and having:

i) an upper tubular body located on a top portion thereof;

ii) two cord passage rings being spaced apart on the top portion thereof;

iii) at least one set of two cord passage hoops being spaced apart thereon and aligning with the two cord passage rings; and iv) a lower tubular section located on a bottom portion thereof;

b) an upper beam located in the upper tubular body;

c) a counterweight located in the lower tubular section;

d) a pull cord having a first end threaded through a first hoop of each of the at least one set of two cord passage hoops, through the two cord passage rings, and through a second hoop of each of the at least one set of two cord passage hoops; and e) a retaining piece, the first end and a second end of the pull cord are slidably inserted through and selectively locked in a predetermined retaining piece position by the retaining piece, wherein the blind body is selectively positioned in a predetermined blind position located between the raised position and the lowered position by adjusting the predetermined retaining piece position of the retaining piece.

2. The Roman-type blind drapery structure according to claim 1, wherein the two cord passage rings are located on a bottom of the upper tubular body.

3. The Roman-type blind drapery structure according to claim 1, wherein the two cord passage rings and the at least one set of two cord passage hoops are located on a rear surface of the blind body.

4. The Roman-type blind drapery structure according to claim 1, wherein the upper beam is a telescoping rod.

5. The Roman-type blind drapery structure according to claim 1, wherein the at least one set of two cord passage hoops includes a lower beam set of two cord passage hoops below the lower tubular section.

6. The Roman-type blind drapery structure according to claim 1, wherein the at least one set of two cord passage hoops includes a plurality of sets of two cord passage hoops located between the and the lower tubular section.

* * * * *